US006726772B2

(12) United States Patent
Owed, Jr.

(10) Patent No.: US 6,726,772 B2
(45) Date of Patent: Apr. 27, 2004

(54) METHOD AND APPARATUS FOR SECURING ARTICLES TO BE COATED TO A CONVEYOR

(75) Inventor: John Paul Owed, Jr., Sylvania, OH (US)

(73) Assignee: Illinois Tool Works Inc., Glenview, IL (US)

( * ) Notice: Subject to any disclaimer, the term of this patent is extended or adjusted under 35 U.S.C. 154(b) by 123 days.

(21) Appl. No.: 10/093,006

(22) Filed: Mar. 7, 2002

(65) Prior Publication Data

US 2003/0170399 A1 Sep. 11, 2003

(51) Int. Cl.[7] ..... B05B 5/025; B05C 13/00
(52) U.S. Cl. ..... 118/635; 118/500
(58) Field of Search ..... 118/500, 504, 118/620, 630, 635; 427/458; 211/113, 118; 204/288.6

(56) References Cited

U.S. PATENT DOCUMENTS

| | | | | |
|---|---|---|---|---|
| 3,777,875 A | | 12/1973 | Sobran | |
| 3,787,707 A | * | 1/1974 | Gregg | 361/113 |
| 3,844,477 A | | 10/1974 | Pollard et al. | |
| 3,853,226 A | * | 12/1974 | Hine et al. | 211/104 |
| 3,873,024 A | | 3/1975 | Probst et al. | |
| 3,981,471 A | | 9/1976 | Currier | |
| 4,097,359 A | | 6/1978 | Davitz | |
| 4,217,853 A | | 8/1980 | Davitz | |
| 4,508,768 A | | 4/1985 | Kornely et al. | |
| 4,628,859 A | | 12/1986 | Hines | |
| 4,703,716 A | | 11/1987 | Hatfield | |
| 4,853,128 A | | 8/1989 | Wrasidlo et al. | |
| 4,902,547 A | | 2/1990 | Good | |
| 5,020,761 A | | 6/1991 | Good et al. | |
| 5,147,050 A | | 9/1992 | Cullen | |
| 5,328,137 A | | 7/1994 | Miller et al. | |
| 5,476,689 A | | 12/1995 | Stone et al. | |
| 5,524,774 A | | 6/1996 | Cullen | |
| 5,542,634 A | | 8/1996 | Pomerantz | |
| 5,551,552 A | | 9/1996 | Ophardt et al. | |
| 5,598,099 A | | 1/1997 | Castleman et al. | |
| 5,728,440 A | | 3/1998 | Good | |
| 5,757,606 A | | 5/1998 | Westerberg | |
| 5,776,554 A | | 7/1998 | Merritt et al. | |
| 5,824,403 A | | 10/1998 | Eidenschink | |
| 5,832,859 A | | 11/1998 | Sawyer et al. | |
| 5,890,604 A | | 4/1999 | Heinz | |
| 5,897,709 A | * | 4/1999 | Torefors | 118/500 |
| 5,908,120 A | | 6/1999 | Yates et al. | |
| 5,949,235 A | | 9/1999 | Castleman et al. | |
| 6,325,899 B1 | | 12/2001 | DeWent | |
| 2002/0015798 A1 | * | 2/2002 | DeWent | 427/458 |

FOREIGN PATENT DOCUMENTS

| | | |
|---|---|---|
| EP | 0 308 142 | 3/1989 |
| EP | 1 034 846 | 9/2000 |
| WO | 96/26406 | 8/1996 |
| WO | 97/00730 | 1/1997 |
| WO | 01/68265 | 9/2001 |

* cited by examiner

*Primary Examiner*—Richard Crispino
*Assistant Examiner*—Yewebdar Tadesse
(74) *Attorney, Agent, or Firm*—Lisa M. Soltis; Mark W. Croll; Donald J. Breh

(57) ABSTRACT

A method and apparatus for coating articles with coating material includes dispensing coating material from a coating dispensing device, maintaining the coating dispensing device at high-magnitude electrostatic potential, coupling articles to a conveyor on hangers constructed from electrically non-insulative strips, and conveying the articles through the dispensed coating material on the hangers.

14 Claims, 1 Drawing Sheet

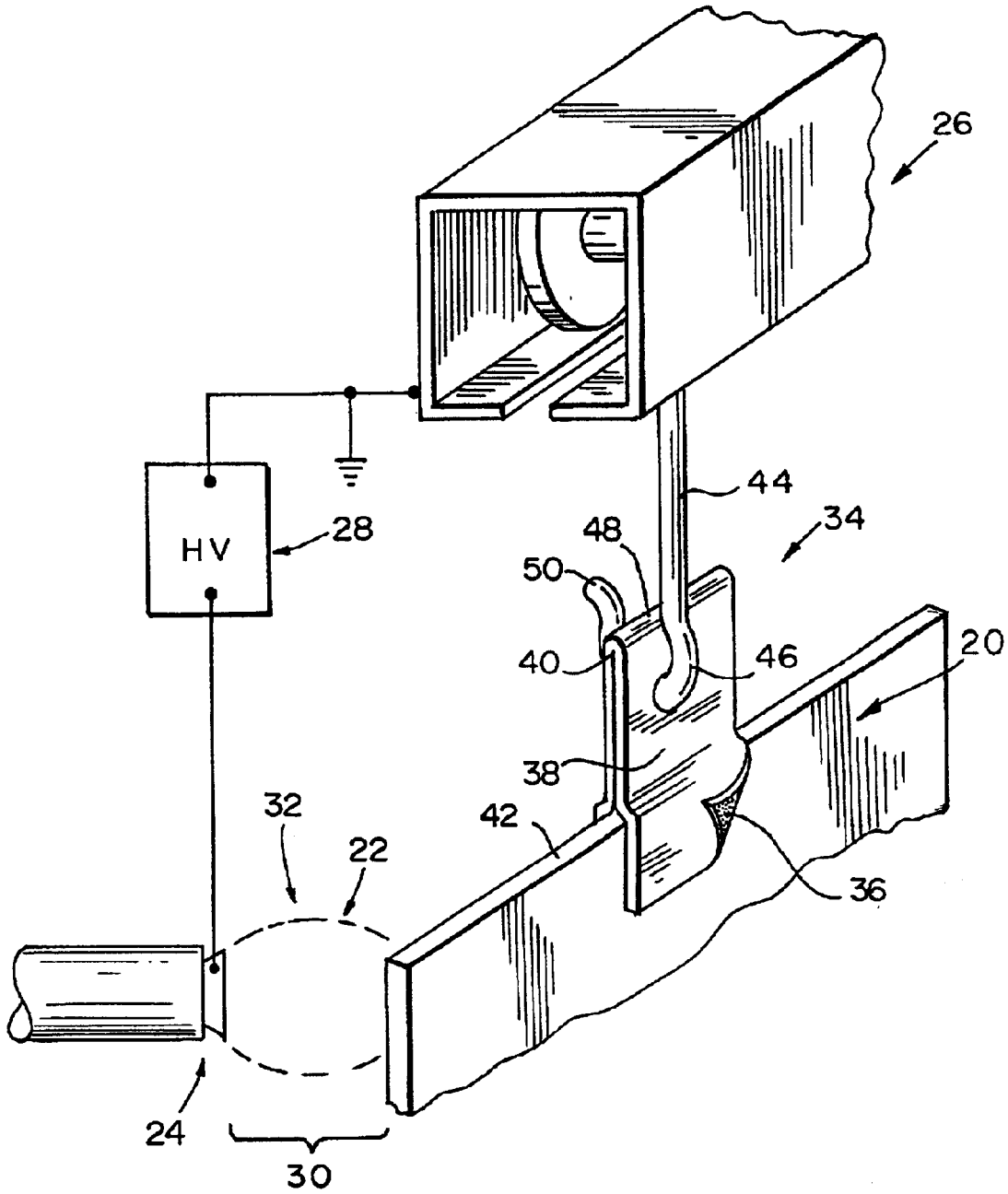
26
44
34
48
50
HV
28
40
46
20
38
32
42
22
36
24
30

METHOD AND APPARATUS FOR SECURING ARTICLES TO BE COATED TO A CONVEYOR

FIELD OF THE INVENTION

This invention relates to the electrostatically-aided atomization and coating of articles. It is disclosed in the context of a facility in which articles to be coated electrostatically are conveyed past coating equipment on a conveyor, but is believed to be useful in other applications as well.

BACKGROUND OF THE INVENTION

In a typical coating system, articles to be coated are generally transported through a coating zone on a mechanical conveyor. The conveyor is typically maintained at or near ground potential and the articles to be coated are supported on the conveyor by hangers which are intended to maintain the parts as nearly as possible at the potential of the conveyor. A coating dispensing device includes some means for charging the dispensed particles of coating material to high-magnitude potential, typically high-magnitude negative potential, with respect to the potential of the conveyor.

Intermittent contact or high-impedance contact between the articles to be coated and the conveyor can result in less than ideal coating results, and waste of coating material. This occurs because the charged coating material, which should migrate along electric field lines from the dispensing device, which is maintained at high-magnitude potential, to the low-magnitude potential maintained on the articles to be coated, instead migrates along field lines established between the dispensing device and other articles and surfaces in the vicinity of the dispensing device which are maintained at low-magnitude potential, such as the conveyor itself. The charged particles of coating material which should be coating the articles are not.

The coating material is thus wasted. And, not only is the coating material wasted, but the wasted coating material particles are deposited on, and coat, components of the conveyor and the hangers upon which the articles to be coated are suspended from the conveyor. This can result in components of the conveyor and hangers being partly coated with the coating material, and buildup of coating material on components of the conveyor and hangers over time. Thus, the pathways to ground for charge on the dispensed coating material sometimes become more and more resistive with time, and less and less of the charged coating material is attracted to, and deposited on, the articles which are to be coated by the coating material. This, in turn, requires removal of components of the conveyor and hangers to be removed from service and cleaned after passing through the coating zone, so that after a number of successive passages, they will not be so covered with a layer of coating material which is sufficiently insulating to prevent electrical contact between the articles to be coated and the grounded conveyor. In summary, many of the benefits associated with electrostatically aided atomization and coating are lost if the articles to be coated are not properly grounded to terminate the electrostatic field.

The need for hangers and associated types of devices for suspending articles to be coated from conveyors for conveying past coating dispensing equipment is well established. Several types of such equipment are known. There are, for example, the devices illustrated and described in U.S. Pat. Nos. 3,777,875; 3,787,707; 3,844,477; 3,873,024; 3,981,471; 4,097,359; 4,217,853; 4,628,859; 4,703,716; 5,147,050; 5,476,689; 5,524,774; 5,551,552; 5,598,099; 5,757,606; 5,776,554; 5,824,403; 5,908,120; 5,949,235; and, 6,325,899, PCT published applications: WO 96/26406; WO 97/00730; and, WO 01/68265, and European published applications 0 308 142 and 1 034 846. There are also the disclosures of U.S. Pat. Nos. 4,508,768; 4,853,128; 4,902,547; 5,020,761; 5,328,137; 5,542,634; 5,728,440; 5,832,859; and, 5,890,604. No representation is intended by this listing that this is a complete listing of all pertinent prior art, or that a thorough search of all pertinent prior art has been conducted, or that no better prior art exists. Nor should any such representation be inferred.

DISCLOSURE OF THE INVENTION

According to one aspect of the invention, hangers are provided for coupling articles to a conveyor for conveyance through electrostatically charged coating material. The hangers are constructed from electrically non-insulative strips.

According to another aspect of the invention, an apparatus for coating articles with coating material includes means for dispensing coating material, means for maintaining the coating dispensing means at high-magnitude electrostatic potential, means for coupling articles to a conveying means. The coupling means includes hangers constructed from electrically non-insulative strips. The means conveys the articles through the dispensed coating material on the hangers.

According to another aspect of the invention, an apparatus for coating articles with coating material includes a coating dispensing device for dispensing coating material, a conveyor for conveying articles past the coating dispensing device to be coated by coating material dispensed from the coating dispensing device, a high-magnitude potential supply for maintaining the coating dispensing device at high-magnitude electrostatic potential, and hangers for coupling articles to the conveyor. The hangers are constructed from electrically non-insulative strips.

Illustratively according to these aspects of the invention, the electrically non-insulative strips are flexible.

Further illustratively according to these aspects of the invention, the electrically non-insulative strips include strips of foil or tape treated to render them electrically non-insulative.

Additionally illustratively according to these aspects of the invention, the electrically non-insulative strips are treated on two sides to render two sides electrically non-insulative.

Illustratively according to these aspects of the invention, each strip includes two opposite ends, and further including an electrically non-insulative adhesive on one side adjacent the two ends.

Further illustratively according to these aspects of the invention, the adhesive permits attachment of a strip to two sides of a respective article, creating a loop for suspending the respective article from the conveyor.

Additionally illustratively according to these aspects of the invention, the strips of foil or tape treated to render them electrically non-insulative include strips of foil or tape metallized to render them electrically non-insulative.

According to another aspect of the invention, a method for coating articles with coating material includes dispensing coating material from a coating dispensing device, maintaining the coating dispensing device at high-magnitude electrostatic potential, coupling articles to a conveyor on hangers constructed from electrically non-insulative strips, and conveying the articles through the dispensed coating material on the hangers.

Illustratively according to this aspect of the invention, coupling articles to the conveyor on hangers constructed from electrically non-insulative strips includes coupling articles to the conveyor on hangers constructed from flexible, electrically non-insulative strips.

Further illustratively according to this aspect of the invention, coupling articles to the conveyor on hangers constructed from electrically non-insulative strips includes coupling articles to the conveyor on hangers constructed from strips of foil or tape treated to render them electrically non-insulative.

Additionally illustratively according to this aspect of the invention, coupling articles to the conveyor on hangers constructed from strips of foil or tape treated to render them electrically non-insulative includes coupling articles to the conveyor on hangers constructed from strips of foil or tape treated on two sides to render two sides electrically non-insulative.

Illustratively according to this aspect of the invention, coupling articles to the conveyor on hangers constructed from strips of foil or tape treated to render them electrically non-insulative includes coupling articles to the conveyor on hangers constructed from strips of foil or tape including two opposite ends, and further including providing an electrically non-insulative adhesive on one side adjacent the two ends.

Further illustratively according to this aspect of the invention, the method includes attaching a strip using the adhesive to two sides of a respective article, thereby creating a loop for suspending the respective article from the conveyor.

Additionally illustratively according to this aspect of the invention, treating the strips of foil or tape to render them electrically non-insulative includes metallizing the strips of foil or tape to render them electrically non-insulative.

According to another aspect of the invention, a coated article is made by dispensing coating material from a coating dispensing device, maintaining the coating dispensing device at high-magnitude electrostatic potential, coupling the article to a conveyor on a hanger constructed from an electrically non-insulative strip, and conveying the article through the dispensed coating material on the hanger.

Illustratively according to this aspect of the invention, the coated article is made by coupling the article to the conveyor on a hanger constructed from a strip of foil or tape treated including two opposite ends, and provided with an electrically non-insulative adhesive on one side adjacent the two ends.

BRIEF DESCRIPTION OF THE DRAWINGS

The invention may best be understood by referring to the following detailed description and accompanying FIGURE which illustrates the invention.

The FIGURE is a highly diagrammatic view of a system according to the invention.

DETAILED DESCRIPTIONS OF ILLUSTRATIVE EMBODIMENTS

Turning now to FIG. 1 articles 20 to be coated by coating material 22 dispensed from a coating dispensing device 24 are conveyed past the coating dispensing device 24 on a conveyor 26. As is well known, appropriate components of the dispensing device 24 can be maintained 28 at high-magnitude electrostatic potential, so that particles of coating material 22 dispensed from the dispensing device 24 into the space 30 between the dispensing device 24 and the articles 20 to be coated as the articles 20 pass by the dispensing device 24 migrate along the electric field 32 thus established between the dispensing device 24 and the articles 20 and deposit on the articles 20, where the particles' electrical charges are conducted away to ground through the hangers 34 for the articles 20 and grounded components of the conveyor 26 to which the hangers 34 are electrically coupled.

As previously noted, coating of the hangers 34 and components of the conveyor 26 upon which the hangers 34 are suspended is not conducive to maintaining relatively low impedance electrical contact between the articles 20 being conveyed past the dispensing device 24 and grounded components of the conveyor 26. In order to address this problem, the hangers 34 according to the invention are inexpensively constructed from electrically non-insulative materials which permits the hangers 34 to be disposable, for example, after a single use.

The hangers 34 according to the present invention are constructed from adhesive 36-backed metallized strips 38 of material, such as furnace/duct tape. The adhesive backing 36 from which the hangers 34 are constructed must be capable of withstanding whatever subsequent steps in the coating process it is subjected to, such as passage through any curing oven or the like. A strip 38 of the material is adhered to each article 20 to be coated, for example, by creating a loop 40 of the material adjacent an edge 42 of the article 20. This edge 42 will become, for example, the top edge 42 of the article 20. A hole 46 can be formed in each hanger 34 adjacent the top 48 of the loop 40 thus formed. A hook 50 on the parts hanger 44 is received in hole 46 to suspend each article 20 for transport along the conveyor 26.

In order to promote low-impedance electrical contact between the hanger 34 and the article 20 to which hanger 34 is adhered, and between the hanger 34 and hook 50 in conjunction with which it is used, the adhesive 36 can be a conductive adhesive. Alternatively, adhesive 36 may be filled with a substance, such as, for example, graphite, which increases the electrical conductivity of the adhesive 36. By the same token, an electrically conductive eyelet, for example, a graphite filled resin eyelet or metal eyelet, can be inserted into each hole 46, either during formation of the hole 46 or subsequently, to promote electrical continuity between the article 20 to be coated and the hook 50 on which the article 20 is being conveyed.

What is claimed is:

1. Apparatus for coating articles with coating material, the apparatus including a coating dispensing device for dispensing coating material, a conveyor for conveying articles past the coating dispensing device to be coated by coating material dispensed from the coating dispensing device, a high-magnitude potential supply for maintaining the coating dispensing device at high-magnitude electrostatic potential, and electrically non-insulative strips of foil or tape for hanging articles from the conveyor.

2. The apparatus of claim 1 wherein the electrically non-insulative strips include strips of foil or tape treated to render them electrically non-insulative.

3. The apparatus of claim 2 wherein the electrically non-insulative strips are treated on two sides to render two sides electrically non-insulative.

4. The apparatus of claim 3 wherein each strip includes two opposite ends, and further including an electrically non-insulative adhesive on one side adjacent the two ends.

5. The apparatus of claim 4 wherein the strips of foil or tape treated to render them electrically non-insulative include strips of foil or tape metallized to render them electrically non-insulative.

6. The apparatus of claim 2 wherein each strip includes two opposite ends, and further including an electrically non-insulative adhesive on one side adjacent the two ends.

7. The apparatus of claim 1 wherein the electrically non-insulative strips are flexible.

8. An apparatus for coating articles with coating material, comprising: means for dispensing coating material; means for maintaining the coating dispensing means at high-magnitude electrostatic potential; means for conveying the articles through the dispensed coating material; and, hangers constructed from electrically non-insulative strips of foil or tape for coupling the articles to the conveying means.

9. Apparatus for coating articles with coating material, the apparatus including a coating dispensing device for dispensing coating material, a conveyor for conveying articles past the coating dispensing device to be coated by coating material dispensed from the coating dispensing device, a high-magnitude potential supply for maintaining the coating dispensing device at high-magnitude electrostatic potential, and strips of foil or tape treated on two sides to render two sides electrically non-insulative for coupling articles to the conveyor, each strip including two opposite ends, and an electrically non-insulative adhesive on one side adjacent the two ends permitting attachment of a strip to two sides of a respective article, creating a loop for suspending the respective article from the conveyor.

10. The apparatus of claim 9 wherein the strips of foil or tape treated to render them electrically non-insulative include strips of foil or tape metallized to render them electrically non-insulative.

11. The apparatus of claim 9 wherein the electrically non-insulative strips are flexible.

12. Apparatus for coating articles with coating material, the apparatus including a coating dispensing device for dispensing coating material, a conveyor for conveying articles past the coating dispensing device to be coated by coating material dispensed from the coating dispensing device, a high-magnitude potential supply for maintaining the coating dispensing device at high-magnitude electrostatic potential, and hangers for coupling articles to the conveyor, the hangers being constructed from strips of foil or tape treated to render them electrically non-insulative, each strip including two opposite ends, and an electrically non-insulative adhesive on one side adjacent the two ends permitting attachment of a strip to two sides of a respective article, creating a loop for suspending the respective article from the conveyor.

13. The apparatus of claim 12 wherein the strips of foil or tape treated to render them electrically non-insulative include strips of foil or tape metallized to render them electrically non-insulative.

14. The apparatus of claim 12 wherein the electrically non-insulative strips are flexible.

* * * * *